US008079313B2

(12) United States Patent
Sparkowski

(10) Patent No.: US 8,079,313 B2
(45) Date of Patent: Dec. 20, 2011

(54) SHELVING SYSTEM WITH REMOVABLE SHELVES

(75) Inventor: Robert P. Sparkowski, Schaumburg, IL (US)

(73) Assignee: Chicago Display Marketing Corporation, River Grove, IL (US)

( * ) Notice: Subject to any disclaimer, the term of this patent is extended or adjusted under 35 U.S.C. 154(b) by 163 days.

(21) Appl. No.: 12/389,275

(22) Filed: Feb. 19, 2009

(65) Prior Publication Data

US 2009/0211997 A1 Aug. 27, 2009

Related U.S. Application Data

(60) Provisional application No. 61/031,935, filed on Feb. 27, 2008.

(51) Int. Cl.
*A47F 5/01* (2006.01)
*A47B 57/00* (2006.01)

(52) U.S. Cl. ..... 108/110; 108/181; 108/186; 211/133.1; 211/187; 248/235

(58) Field of Classification Search ..... 211/90.01, 211/90.02, 103, 133.1, 133.2, 133.3, 153, 211/186, 187, 189, 190, 207, 147.16, 147.17; 108/106, 107, 108, 109, 110, 180, 181, 186; 248/235, 249, 250

See application file for complete search history.

(56) References Cited

U.S. PATENT DOCUMENTS 366,051 A * 7/1887 Weatherley ..... 108/1
678,031 A * 7/1901 Peach ..... 108/103
831,389 A * 9/1906 Steeg ..... 108/106
1,201,703 A * 10/1916 Davidson ..... 108/108
1,995,399 A * 3/1935 Reedy et al. ..... 126/339
2,230,374 A * 2/1941 Carver ..... 108/96
2,254,770 A * 9/1941 Bitney ..... 108/186
2,268,748 A * 1/1942 Glenny ..... 108/176
2,562,497 A * 7/1951 Klein ..... 108/107
2,894,642 A * 7/1959 Clevett, Jr. et al. ..... 108/106
2,915,196 A * 12/1959 Pira ..... 108/109
2,941,772 A * 6/1960 Thayer et al. ..... 108/53.1
2,982,424 A * 5/1961 Van Syoc, Sr. ..... 108/187
3,387,855 A * 6/1968 Oliver ..... 280/79.3
3,435,958 A * 4/1969 Chesley ..... 211/133.2
3,487,951 A * 1/1970 Beltzung ..... 211/133.2
3,502,225 A * 3/1970 Oliver ..... 211/133.2
3,536,016 A * 10/1970 Chesley ..... 108/181
3,743,105 A * 7/1973 David ..... 211/153
3,771,466 A * 11/1973 Ferdinand et al. ..... 108/109
3,921,539 A * 11/1975 Berger ..... 108/8
3,977,529 A * 8/1976 Stroh ..... 211/187
4,541,344 A * 9/1985 Nichols ..... 108/108
4,558,647 A * 12/1985 Petersen ..... 108/107
5,913,270 A * 6/1999 Price ..... 108/101
(Continued)

*Primary Examiner* — Michael Safavi
*Assistant Examiner* — Joshua Rodden
(74) *Attorney, Agent, or Firm* — Michael Best & Friedrich LLP

(57) ABSTRACT

A shelving system including a pair of upright members, a plurality of cross-members extending between the upright members, and a plurality of shelves. Each shelf includes a plurality of first wire members defining a support surface, as well as at least two second wire members defining a support channel. Portions of the second wire members are upturned and define first and second engagement members. During assembly, each shelf is lowered onto a cross-member until the support channel engages the cross-member, whereupon the engagement members receive a respective upright member and thereby prevent rotation of the shelf about the cross-member.

12 Claims, 6 Drawing Sheets

U.S. PATENT DOCUMENTS

| | | | | |
|---|---|---|---|---|
| 6,123,209 | A * | 9/2000 | Tseng | 211/186 |
| 6,173,847 | B1 * | 1/2001 | Zellner et al. | 211/186 |
| 6,364,137 | B1 * | 4/2002 | Glauth et al. | 211/186 |
| 6,378,712 | B1 * | 4/2002 | Sampl | 211/186 |
| D565,324 | S * | 4/2008 | Sparkowski | D6/465 |
| D573,369 | S * | 7/2008 | Sparkowski | D6/463 |
| 2001/0004064 | A1 * | 6/2001 | Battaglia et al. | 211/187 |
| 2009/0152225 | A1 * | 6/2009 | Lee | 211/187 |
| 2010/0000449 | A1 * | 1/2010 | Botkin | 108/152 |

* cited by examiner

SHELVING SYSTEM WITH REMOVABLE SHELVES

CROSS REFERENCE TO RELATED APPLICATION

This application claims the benefit of and priority to U.S. Provisional Patent Application No. 61/031,935, filed Feb. 27, 2008, the entire contents of which are hereby incorporated by reference.

BACKGROUND

Shelving systems are available in a wide variety of shapes and configurations. Shelving systems exist that may be permanently coupled to walls or other structures. Freestanding shelving systems that are supported by the ground or dedicated base structures are also known.

SUMMARY

In some embodiments, the invention provides a shelving unit including a first upright member and a second upright member spaced from the first upright member. The shelving unit also includes a plurality of laterally extending and vertically spaced-apart cross-members that are coupled to at least one of the first upright member and the second upright member, and a plurality shelves. Each shelf is supported by a respective one of the plurality of cross-members and defines a support surface extending forwardly and rearwardly away from the respective cross-member. Each shelf includes a first engagement member that extends upwardly and/or downwardly relative to the support surface and that engages the first upright member, and a second engagement member that extends upwardly and/or downwardly relative to the support surface and that engages the second upright member. The first and second engagement members cooperate to substantially prevent rotation of the shelf about the cross-member.

In some embodiments, the invention provides a shelving unit including a first upright member, a second upright member spaced a distance L from the first upright member, and a plurality of cross-members coupled to at least one of the first upright member and the second upright member. Each cross-member is vertically spaced a distance H from adjacent cross-members. The shelving unit also includes a plurality of removable and interchangeable shelves. Each shelf is supported by a respective one of the cross-members and defines a support surface that extends forwardly and rearwardly away from the cross-member. Each shelf also includes engagement members that extend laterally above and/or below the support surface for engagement with a respective one of the uprights. The engagement members substantially prevent rotation of the shelf about the cross-member. The engagement members are spaced apart by a distance D that is greater than the distance L but less than the square root of the sum of the distance L squared and the distance H squared.

In some embodiments, the invention provides a method of installing a shelf into a shelving unit. The shelving unit includes a first upright, a second upright spaced a distance from the first upright, and a plurality of vertically spaced-apart cross-members positioned between the first and second uprights. The shelf defines a support surface and a support channel facing in an opposite direction as the support surface, and includes a first engagement member on a first end of the shelf and a second engagement member on a second end of the shelf. The method includes inserting the shelf at an angle between the first and second upright members and between two adjacent cross-members such that the first engagement member is below the second engagement member. The first engagement member is engaged with the first upright, and the second engagement member is aligned with the second upright. The shelf is rotated downwardly to move the second engagement member into engagement with the second upright until the support channel receives the cross-member, such that engagement between the engagement members and the uprights substantially prevents rotation of the shelf about the cross-member.

Figure 1:
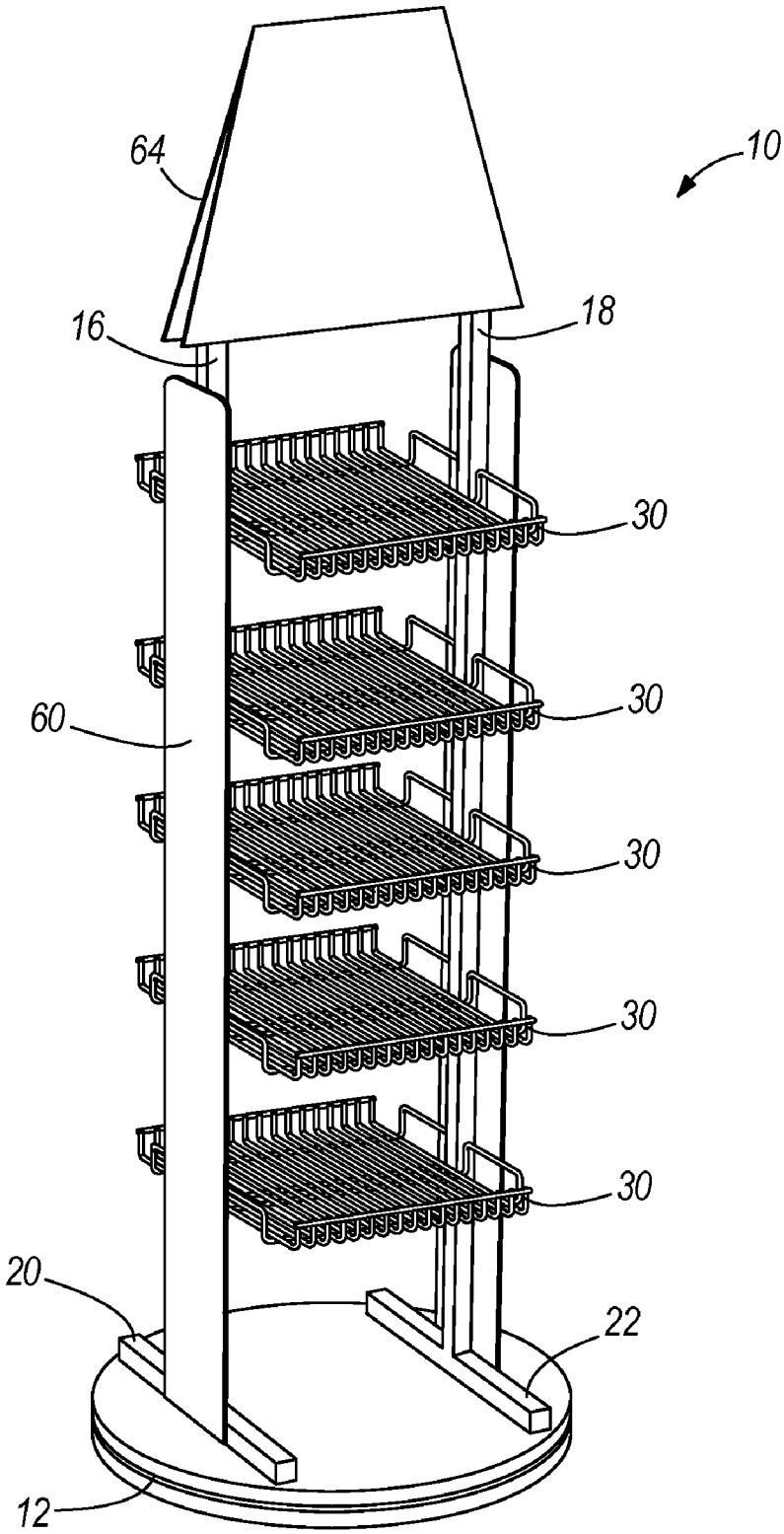
FIG. 1 is a perspective view of a shelving system.
Figure 4:
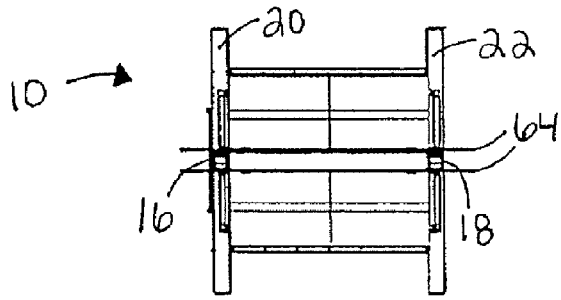
FIG. 4 is a top view of the shelving system of FIG. 1.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

FIGS. 1-4 illustrate a shelving system 10 embodying the invention. The shelving system 10 includes a base 12 that, in the illustrated construction, is substantially circular, but which may also be any structure of various shapes such as rectangular, oval, squared, or the like, having a pair of opposing flat surfaces. A first upright member 16 and a second upright member 18 extend generally vertically upwardly from the base 12 relative to the ground. The first upright member 16 and second upright member 18 each include a foot 20, 22, respectively, that rests upon or may be connected to the base 12.

Figure 3:
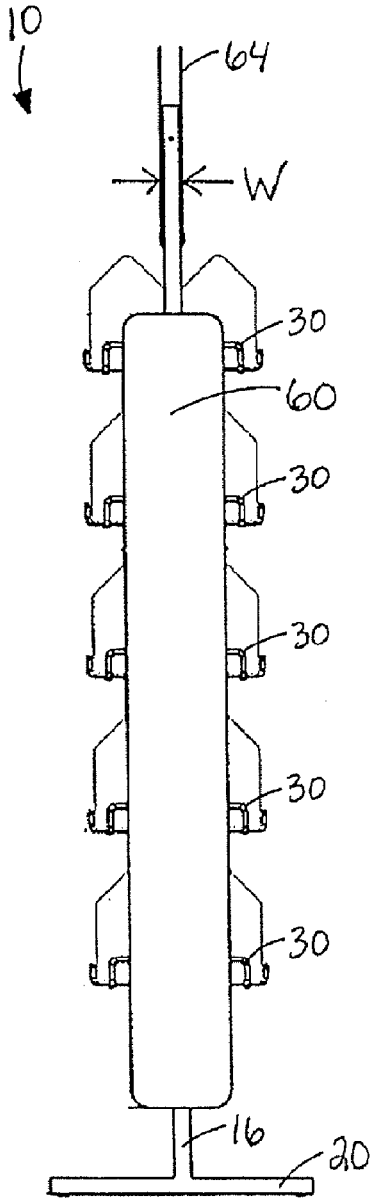
FIG. 3 is a side view of the shelving system of FIG. 1.
Figure 2:
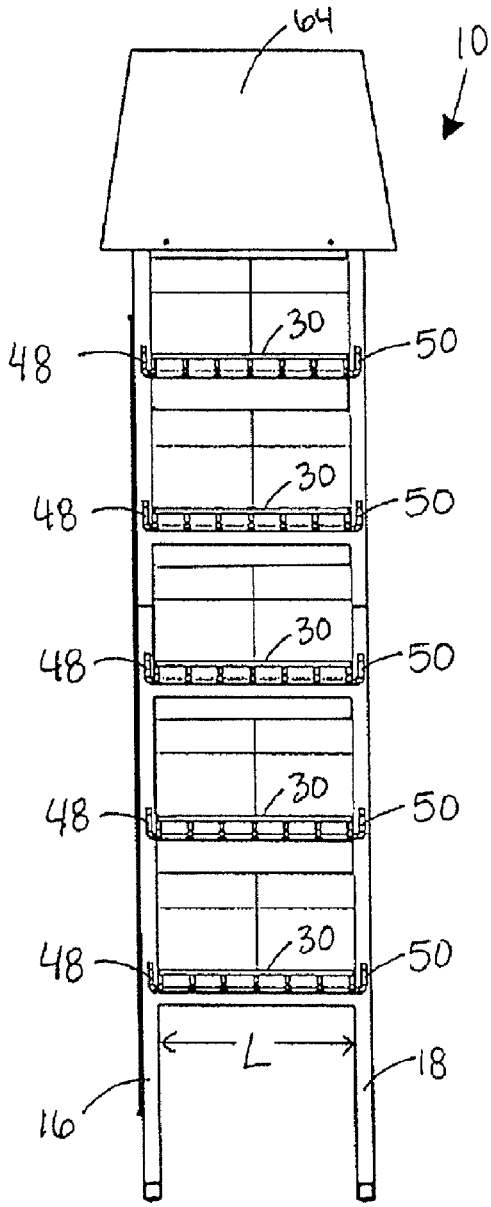
FIG. 2 is a front view of the shelving system of FIG. 1.

The first and second upright members 16, 18 are laterally spaced apart from one another, and each upright member 16, 18 includes a width, W (see FIG. 3). A plurality of spaced-apart shelf supports in the form of cross-members 26 (see FIG. 6) extend between and are coupled to the first and second upright members 16, 18. The cross-members 26 each define a length L (see FIG. 2) that also defines a spacing distance between the first and second upright members 16, 18. In the illustrated construction, the cross-members 26 are coupled to the first and second upright members 16, 18 by welding, however other coupling methods such as brazing, soldering, or the use of fasteners such as bolts or screws may be used. As illustrated, each cross-member 26 includes a width W that is substantially equal to the width of the first and second upright members 16, 18 for reasons discussed further below; however, other embodiments of the invention may include cross-members 26 having different or differing widths relative to the other cross-members 26 or to the first and second upright members 16, 18.

Figure 5:
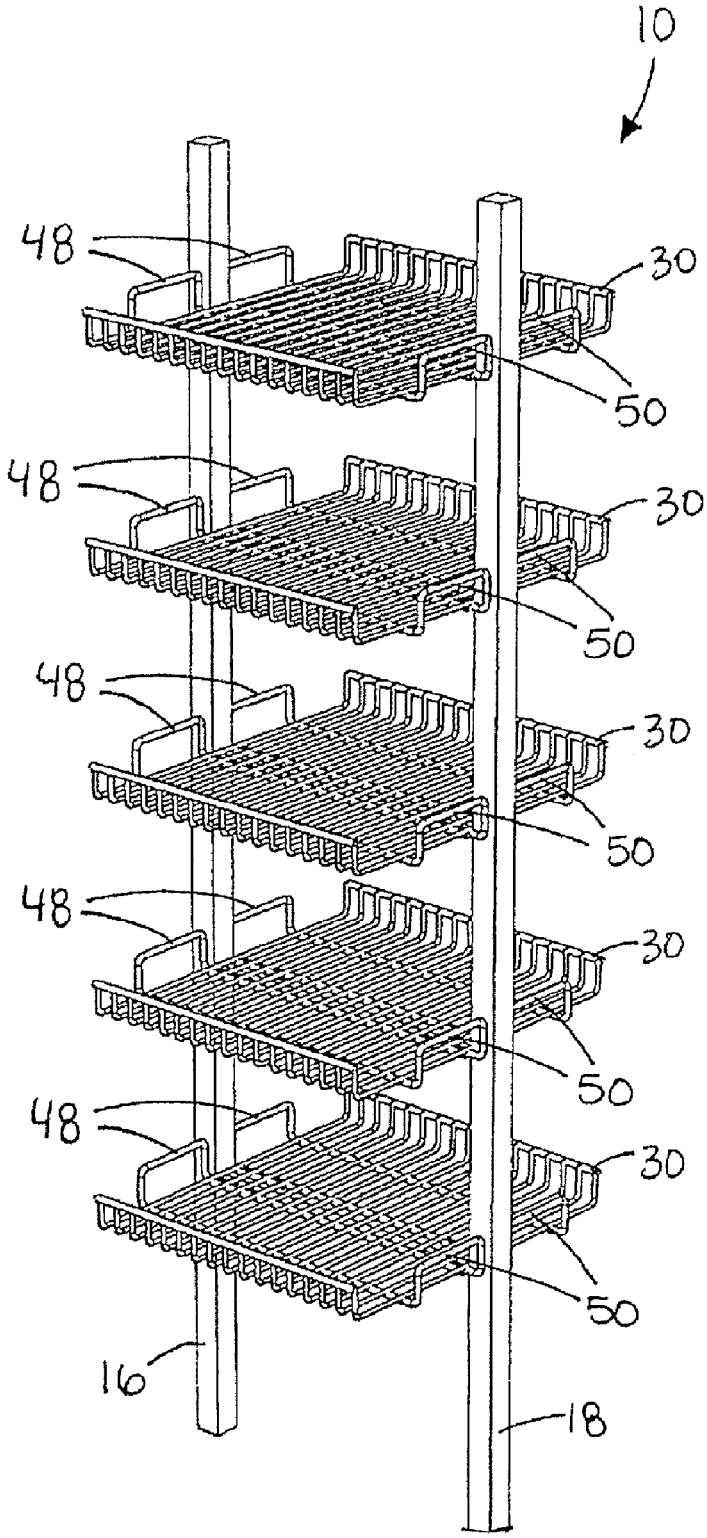
FIG. 5 is a perspective view of a portion of the shelving system of FIG. 1.
Figure 6:
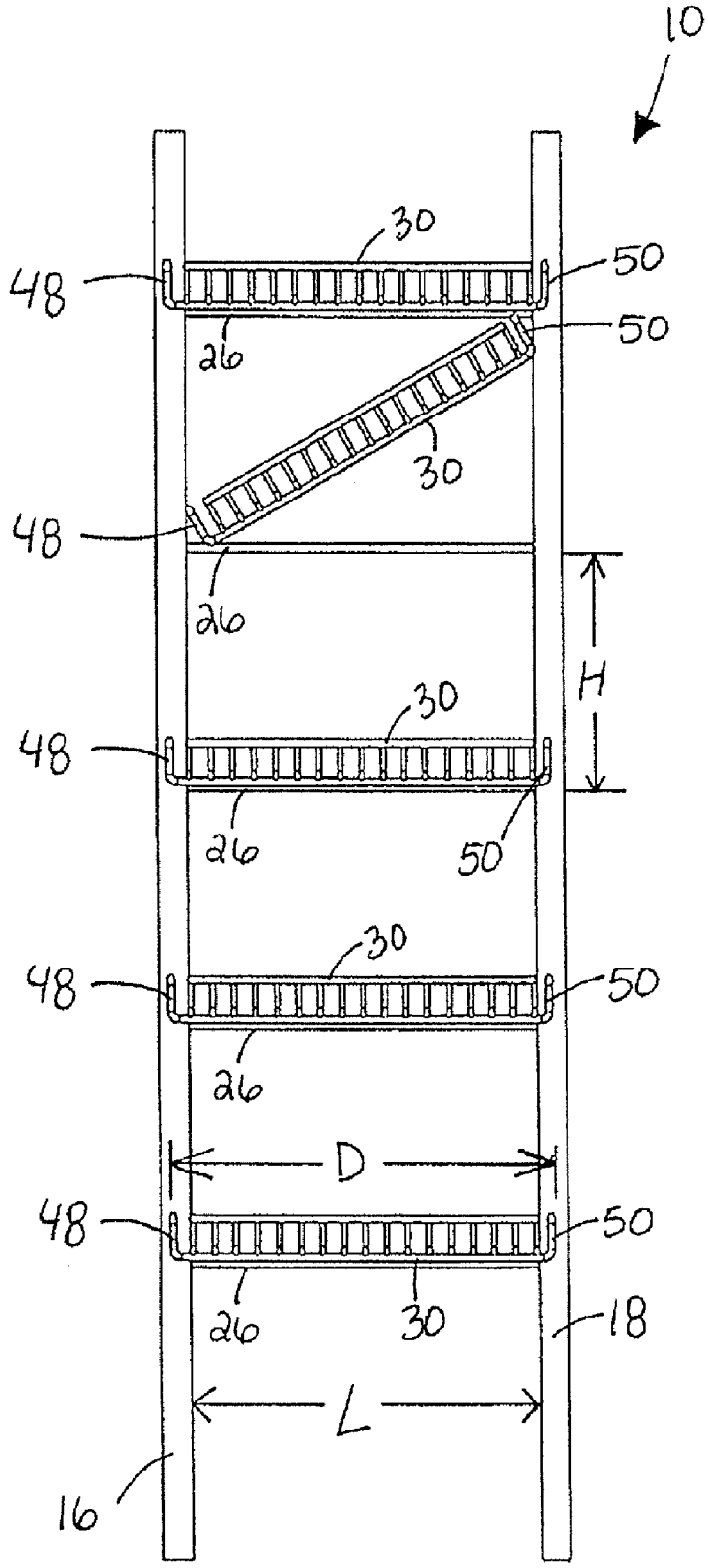
FIG. 6 is a front view of the portion of the shelving system of FIG. 5 with one shelf illustrated in an assembly position.
Figure 7:
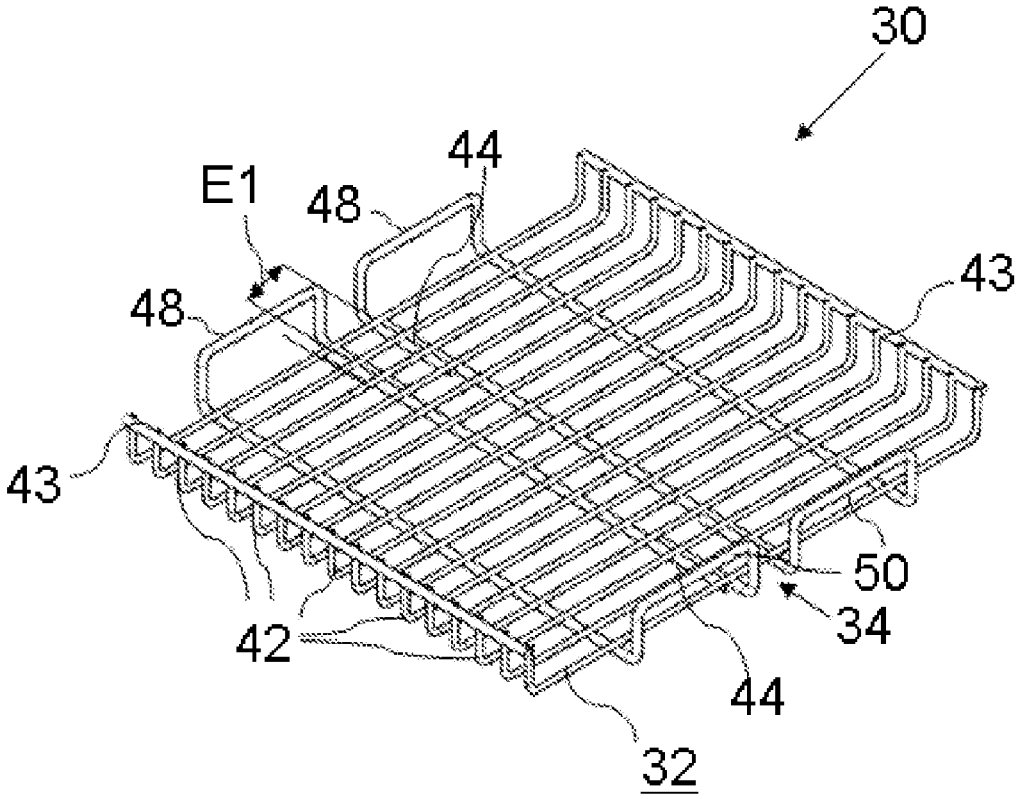
FIG. 7 is a perspective view of a shelf of the shelving system of FIG. 1.

Referring also to FIGS. 5-7, the shelving system 10 also includes a plurality of support members in the form of shelves 30. The shelves are generally rectangular, but again, various shapes may be used. The illustrated construction includes five shelves 30; however, more or fewer shelves 30 may be provided as desired for a specific application. Each shelf 30 is defined by a plurality of wire members including a plurality of first wire members 42 and at least two second wire members 44. The first wire members 42 are spaced apart from and extend substantially parallel to one another. Forward and rearward ends of the first wire members 42 are upturned and joined together by wire connectors 43, which define the front and back edges of the shelf 30. Together the first wire members 42 define an upwardly facing support surface 32 of the shelf 30, with the support surface 32 below the wire connectors 43. The second wire members 44 are loops coupled to the first wire members 42 on a side opposite the support surface 32 (e.g., the underside of the first wire members 42). The second wire members 44 are spaced apart from and extend substantially parallel to one another and perpendicular to the first wire members 42. Portions of the second wire members 44 are formed to extend outwardly and at an angle (e.g., 90 degrees upwardly, as illustrated) relative to the support surface 32 to define opposed pairs of first and second engagement members 48, 50, which extend along those sides of the shelf not defined by wire connectors 43. The space between the two second wire members 44 and below support surface 32 defines a support channel 34 that extends along the underside of the shelf. In the illustrated construction, the support channel 34 is substantially centered between the wire connectors 43 that define the front and back edges of the shelf 30. Furthermore, although the illustrated construction includes shelves 30 formed of individual wires, the shelves could also be formed of, for example, one or more pieces of solid metal, wood, and/or plastic that are suitably formed to include the support surface 32, the engagement members 48, 50, and the support channel 34.

In the illustrated embodiment, the first engagement members 48 include elongated rod members that are spaced apart from each other by a distance E1 sufficient to allow the engagement members 48 to receive therebetween the first upright member 16. The second engagement members 50 also include elongated rod members that are spaced apart from each other by a distance E2 sufficient to allow the second pair of engagement members 50 to receive the second upright member 18. In the illustrated construction, the distance E1 between the pair of first engagement members 48 is substantially equal to the distance E2 between the pair of second engagement members 50, both of which are substantially equal to the width W of the upright members 16, 18. Furthermore, a distance D that extends from the first engagement members 48 to the second engagement members 50 is greater than the length L defining the distance between the upright members 16, 18. In this regard, when the shelf is positioned on one of the cross-members 26, each pair of engagement members 48, 50 snugly receives a respective one of the upright members 16, 18 and engages the forward and rearward surfaces thereof to stabilize the shelf 30 against pivotal movement about a substantially horizontal axis.

As illustrated, the support channel 34 of each shelf 30 extends along the underside of the shelf 30 opposite from the support surface 32. The second wire members 44 are spaced to receive one of the plurality of cross-members 26 when the shelf 30 is positioned substantially horizontally between the first and second upright members 16, 18. In the illustrated embodiment, the spacing between the second wire members 44 (i.e. the width of the support channel 34) is substantially equal to the width W because the upright members 16, 18 and the cross-members 26 include substantially identical and substantially square cross-sections.

The shelving system 10 is configured so that the shelves 30 can be quickly and easily installed, removed, and re-arranged at different levels without the use of tools or fasteners. The first and second upright members 16, 18 are spaced apart horizontally by the distance L, and the cross-members 26 are spaced vertically from one another by a distance H (see FIG. 6). The distances L and H are sufficient to allow each shelf 30 to be inserted between the first and second upright members 16, 18, and between adjacent cross-members 26 at an angle relative to the lower of the two adjacent cross-members 26. To achieve this, a distance D (see FIG. 6) that extends across the shelf 30 from the first pair of engagement members 48 to the second pair of engagement members 50 must be less than the square root of the sum of the distance L squared and the distance H squared. As discussed above, the distance D is also greater than the length L, which provides the relationship $L<D<\sqrt{(L^2+H^2)}$.

As illustrated in FIGS. 1-4, the shelving system 10 may also include a side panel 60 coupled to the first upright member 16. Although not shown, a second side panel may also be coupled to the second upright member 18. The side panel 60 or panels may be coupled to the upright members 16, 18 by any suitable fasteners or coupling devices including, for example, clips, bolts, screws, ties and the like, as generally known to those skilled in the art. The shelving system 10 may further include a topper 64 coupled to and extending between the upright members 16, 18. The topper 64 may be coupled using any suitable fastener The side panels 60 and topper 64 provide display surfaces suitable for advertising or product-related indicia.

To install shelves on the shelving system 10, one of the shelves 30 is inserted between two adjacent cross-members 26 and between the first and second upright members 16, 18 such that the support surface 32 is positioned at an acute angle with respect to the lower cross-member 26. The first pair of engagement members 48 is aligned to receive the first upright member 16 between members 48, and the second pair of engagement members 50 is aligned to receive the second upright member 18 between members 50. In this way, a front portion of the shelf extends forwardly of the upright members 16, 18, and a rear portion of the shelf extends rearwardly of the upright members 16, 18. The elevated end of the shelf 30 is then moved downwardly toward the lower cross-member 26 until the support channel 34 engages the lower cross-member 26, and the first and second pairs of engagement members 48, 50 engage the first and second upright members 16, 18, respectively, to couple the shelf 30 to the shelving assembly 10. Additional shelves 30 are similarly added to the shelving system 10 as desired. The relative widths of and spacings between the upright members 16, 18, the cross-members 26, the second wire members 44, and the engagement members 48, 50, combined with the relative length of the shelves 30 provide a secure yet easily removable coupling that allows the shelves 30 to be installed and removed without the use of tools or fasteners.

Figure 8:
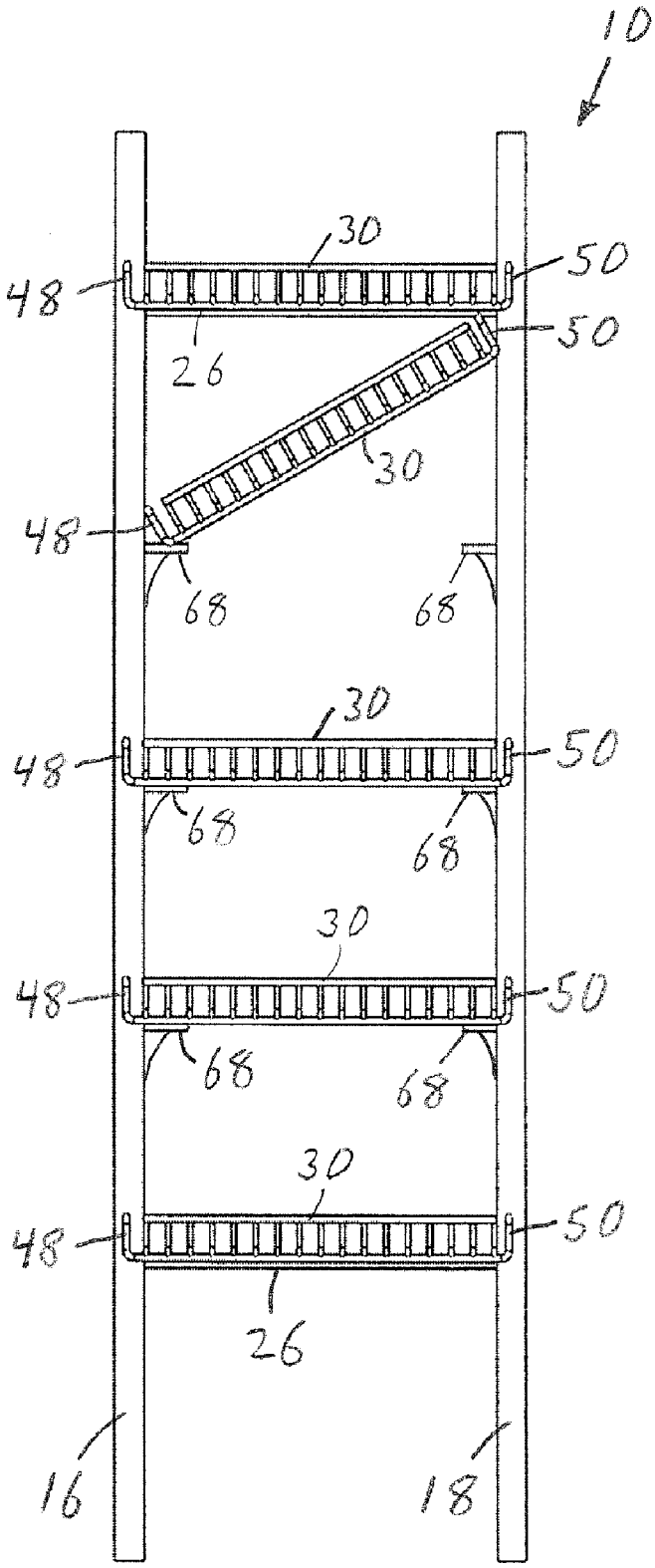
FIG. 8 is a front view similar to FIG. 6 illustrating the shelving system with an alternative form of cross-members.

As illustrated in FIG. 8, in some embodiments of the shelving system 10, one or more of the cross-member 26 shelf supports may be replaced by shelf supports in the form of opposed clip members 68 that are removably attachable at varying heights along the upright members 16, 18. Each clip member 68 extends a relatively short distance laterally inwardly from its respective upright member 16, 18 toward the opposite upright member 18, 16. The clip members 68 and upright members 16, 18 may be provided with a wide variety of complimentary coupling features for coupling the clip members 68 to the upright members 16, 18, including posts and holes, tabs and slots, and keys and keyways, to name a few. Such coupling features generally allow the clip members 68 to be easily moved to different vertical positions along the uprights 16, 18 to adjust the height and/or relative spacing between the shelves 30. In some embodiments, including the embodiment of FIG. 8, at least one cross-member 26 extends between the upright members 16, 18 to substantially fix the distance between the upright members 16, 18. In other embodiments, the shelving system includes a combination of a plurality of upright members 16, 18 and a plurality of clip members to support the shelves 30.

The invention claimed is:

1. A shelving unit comprising:

a first upright member;

a second upright member spaced in a lateral direction from the first upright member;

a plurality of vertically spaced-apart cross-members extending in the lateral direction and coupled to at least one of the first upright member and the second upright member; and a plurality of shelves, each shelf positioned on a respective one of the plurality of cross-members and defining a support surface extending in the lateral direction between the first upright member and the second upright member and extending away from the respective cross-member in forward and rearward directions that are substantially perpendicular to the lateral direction, each shelf including a first engagement member extending at an angle relative to the support surface and engaging the first upright member, and a second engagement member extending at an angle relative to the support surface and engaging the second upright member, the first and second engagement members cooperating to substantially prevent rotation of the shelf about the cross-member, wherein each engagement member includes a pair of spaced apart elongated members, wherein each upright includes an upright width, wherein the elongated members of each engagement member are spaced apart by an elongated member distance that is substantially equal to the upright width, wherein the pair of elongated members of the first engagement member receives therebetween the first upright, and the pair of elongated members of the second engagement member receives therebetween the second upright, wherein the support surface of each shelf is defined by a plurality of first wire members extending substantially perpendicular to the cross-members, the first wire members having upturned forward ends and upturned rearward ends, the forward ends connected to one another by a first wire connector and the rearward ends connected to one another by a second wire connector, and wherein the engagement members are defined by a plurality of second wire members extending substantially perpendicular to the plurality of first wire members, the second wire members extending along an underside of the first wire members to define a support channel, and the second wire members including angled end portions that define the engagement members.

2. The shelving unit of claim 1, wherein each upright includes a forward face and a rearward face, and wherein each engagement member engages at least one of the forward and rearward faces.

3. The shelving unit of claim 1, wherein the support channel receives the respective one of the plurality of cross-members.

4. The shelving unit of claim 3, wherein the uprights are spaced from one another by an upright distance, wherein the engagement members of each shelf are spaced from one another by an engagement member distance that is greater than the upright distance, and wherein the support surface of each shelf includes a surface width that is substantially equal to the upright distance.

5. The shelving unit of claim 3, wherein the support channel of each shelf defines a channel width substantially equal to the elongated member distance, and wherein the cross-members each include a cross-member width that is substantially equal to the upright width.

6. The shelving unit of claim 1, further comprising at least one of a side panel and a topper coupled to at least one of the uprights.

7. The shelving unit of claim 1, further including pairs of opposed clip members, each clip member coupled to a respective one of the uprights and extending inwardly toward an opposite upright.

8. The shelving unit of claim 1, wherein the shelves are interchangeable with one another and are securable to and removable from the cross-members and the uprights without the use of tools.

9. The shelving unit of claim 1, wherein the support channel is substantially centered between the upturned forward and upturned rearward ends of the first wire members.

10. A shelving unit comprising:

a first upright member;

a second upright member spaced in a lateral direction by a distance L from the first upright member;

a plurality of cross-members extending in the lateral direction and coupled to at least one of the first upright member and the second upright member, each cross-member vertically spaced a distance H from an adjacent cross-member; and a plurality of removable and interchangeable shelves, each shelf positioned on a respective one of the cross-members and defining a support surface that extends in the lateral direction between the first upright member and the second upright member and that extends away from the respective cross-member in forward and rearward directions that are substantially perpendicular to the lateral direction, each shelf also including a first engagement member and a second engagement member each of which extends at an angle relative to the support surface, the first engagement member engaging the first upright member and the second engagement member engaging the second upright member to substantially prevent rotation of the shelf about the cross-member, the first engagement member spaced apart from the second engagement member by a distance D that is greater than the distance L but less than the square root of the sum of the distance L squared and the distance H squared, wherein each engagement member includes a pair of spaced apart elongated members, wherein each upright includes an upright width, wherein the elongated members of each engagement member are spaced apart by an elongated member distance that is substantially equal to the upright width, wherein the pair of elongated members of each engagement member receives therebetween one of the first and second uprights, wherein the support surface of each shelf is defined by a plurality of first wire members extending substantially perpendicular to the cross-members, the first wire members having upturned forward ends and upturned rearward ends, the forward ends connected to one another by a first wire connector and the rearward ends connected to one another by a second wire connector, and wherein the engagement members are defined by a plurality of second wire members extending substantially perpendicular to the plurality of first wire members, the second wire members extending along an underside of the first wire members to define a support channel, and including angled end portions that define the engagement members.

11. The shelving unit of claim 10, wherein the support channel receives the respective one of the cross-members, wherein a first width of the support channel and the elongated member distance are substantially equal, and wherein the uprights and the cross-members include a second width that is substantially equal to the first width and the elongated member distance.

12. The shelving unit of claim 10, further including pairs of opposed clip members, each clip member coupled to a respective one of the uprights and extending inwardly toward an opposite upright.

* * * * *